US007207466B2

(12) United States Patent
Walsh et al.

(10) Patent No.: US 7,207,466 B2
(45) Date of Patent: Apr. 24, 2007

(54) SPOUT

(75) Inventors: Michael J. Walsh, Chesterfield, MO (US); Edward A. Raleigh, Lodi, WI (US); Timothy J. Bierman, Sun Prairie, WI (US); Scott G. Manke, Sun Prairie, WI (US)

(73) Assignee: Masterchem Industries LLC, Imperial, MO (US)

( * ) Notice: Subject to any disclaimer, the term of this patent is extended or adjusted under 35 U.S.C. 154(b) by 327 days.

(21) Appl. No.: 10/627,200

(22) Filed: Jul. 25, 2003

(65) Prior Publication Data

US 2004/0164095 A1 Aug. 26, 2004

Related U.S. Application Data

(63) Continuation-in-part of application No. 10/255,564, filed on Sep. 25, 2002, which is a continuation-in-part of application No. 10/132,682, filed on Apr. 25, 2002, now Pat. No. 7,014,078, which is a continuation-in-part of application No. 10/006,985, filed on Dec. 5, 2001, now Pat. No. 7,036,693.

(60) Provisional application No. 60/485,674, filed on Jul. 9, 2003.

(51) Int. Cl.
*B67D 1/16* (2006.01)

(52) U.S. Cl. ..... 222/111; 222/109; 222/465.1; 222/566; 222/569; 222/575

(58) Field of Classification Search ..... 222/109, 222/111, 566–575, 465.1, 466; 220/699–702, 220/770–771

See application file for complete search history.

(56) References Cited

U.S. PATENT DOCUMENTS

| | | | | |
|---|---|---|---|---|
| 129,303 | A | | 7/1872 | Wright |
| 1,768,098 | A | * | 6/1930 | Aulbach ..... 222/109 |
| 2,102,057 | A | | 12/1937 | Chamberlain |
| 2,347,401 | A | | 4/1944 | Davey |
| 2,763,403 | A | | 9/1956 | Livingstone |
| 2,889,079 | A | | 6/1959 | Livingstone |
| D204,171 | S | | 3/1966 | Szajna |
| 3,300,104 | A | | 1/1967 | Burt |
| 3,323,691 | A | | 6/1967 | Ruetz |

(Continued)

FOREIGN PATENT DOCUMENTS

| | | |
|---|---|---|
| CA | 495276 | 8/1953 |

(Continued)

*Primary Examiner*—Frederick C. Nicolas
(74) *Attorney, Agent, or Firm*—Foley & Lardner LLP

(57) ABSTRACT

An insert for a container includes an outer wall, a upstanding spout, and a bottom wall. The outer wall is configured to fit within an opening of the container and defines the periphery of the insert. The outer wall has a lower edge and an upper edge that is disposed at a first elevation. The upstanding spout is located within the outer wall and includes at least one substantially straight portion. The straight portion has a lower edge as well as a substantially straight upper edge that is disposed at a second elevation less than the first elevation. The bottom wall connects the lower edge of the outer wall and the lower edge of the spout to form a channel between the outer wall and the spout.

40 Claims, 8 Drawing Sheets

U.S. PATENT DOCUMENTS

| | | | | |
|---|---|---|---|---|
| 3,387,749 | A | | 6/1968 | Godshalk et al. |
| 3,463,366 | A | | 8/1969 | Spencer |
| 3,659,758 | A | | 5/1972 | Waterman |
| 3,695,488 | A | | 10/1972 | Olsson |
| 3,833,150 | A | | 9/1974 | Visser-Patings |
| 3,899,107 | A | | 8/1975 | Gaal |
| 3,942,688 | A | | 3/1976 | Pryor et al. |
| 3,972,453 | A | | 8/1976 | Kapples |
| 3,980,213 | A | | 9/1976 | Ramsay |
| 4,009,802 | A | | 3/1977 | Hayduchok |
| 4,014,465 | A | | 3/1977 | Ritter |
| 4,078,700 | A | | 3/1978 | Hidding |
| D249,646 | S | | 9/1978 | Ritter |
| 4,125,210 | A | | 11/1978 | Embree |
| 4,203,537 | A | | 5/1980 | McAlister |
| 4,225,064 | A | | 9/1980 | Westcott |
| 4,235,348 | A | | 11/1980 | Watson |
| 4,240,568 | A | | 12/1980 | Pool |
| D258,563 | S | | 3/1981 | Romagnoli |
| 4,491,234 | A | | 1/1985 | Wilcock |
| 4,619,372 | A | | 10/1986 | McFarland |
| D288,535 | S | | 3/1987 | Bozich |
| 4,669,640 | A | | 6/1987 | Ando et al. |
| 4,696,416 | A | | 9/1987 | Muckenfuhs et al. |
| D292,490 | S | | 10/1987 | Kowollik et al. |
| 4,702,395 | A | | 10/1987 | Nitsch |
| 4,736,874 | A | | 4/1988 | Durant |
| 4,771,501 | A | | 9/1988 | Leiter |
| 4,799,306 | A | | 1/1989 | Collins et al. |
| D302,526 | S | | 8/1989 | Ritter |
| 4,890,770 | A | * | 1/1990 | Haga et al. ..... 222/109 |
| 4,911,319 | A | | 3/1990 | DeJean |
| 4,941,586 | A | | 7/1990 | Tarna |
| 5,012,960 | A | | 5/1991 | Arnold |
| D321,325 | S | | 11/1991 | Petrus |
| D322,221 | S | | 12/1991 | Neff |
| D323,115 | S | | 1/1992 | Kelsey |
| 5,123,576 | A | | 6/1992 | Lawrence |
| 5,158,216 | A | | 10/1992 | Viani |
| 5,195,662 | A | | 3/1993 | Neff |
| 5,251,788 | A | | 10/1993 | Moore |
| 5,269,438 | A | | 12/1993 | Kelsey |
| D355,854 | S | | 2/1995 | Baron et al. |
| 5,392,969 | A | | 2/1995 | Usery |
| 5,435,467 | A | | 7/1995 | Ekkert et al. |
| 5,443,184 | A | | 8/1995 | Broitzman |
| D362,180 | S | | 9/1995 | Haines |
| D366,617 | S | | 1/1996 | Hotz |
| 5,533,802 | A | | 7/1996 | Garganese |
| 5,568,879 | A | | 10/1996 | Kovathana |
| 5,582,315 | A | | 12/1996 | Reid |
| 5,597,090 | A | | 1/1997 | Leahy |
| D379,302 | S | | 5/1997 | Rodman |
| 5,626,298 | A | | 5/1997 | Arnoldy |
| 5,669,526 | A | | 9/1997 | Keyfauver |
| 5,794,803 | A | * | 8/1998 | Sprick ..... 215/217 |
| 5,810,196 | A | | 9/1998 | Lundy |
| 5,855,304 | A | | 1/1999 | Dean et al. |
| 5,890,628 | A | | 4/1999 | Simpson et al. |
| 5,921,448 | A | | 7/1999 | Stewart |
| 5,927,535 | A | | 7/1999 | Goth |
| 5,941,427 | A | | 8/1999 | Speer |
| 5,971,201 | A | | 10/1999 | Daw |
| D424,440 | S | | 5/2000 | Wilkinson et al. |
| D425,792 | S | | 5/2000 | Haller |
| 6,068,161 | A | | 5/2000 | Soehnlen et al. |
| 6,085,949 | A | | 7/2000 | Zimny et al. |
| 6,158,632 | A | | 12/2000 | Ekkert |
| D436,033 | S | | 1/2001 | Croft et al. |
| 6,189,725 | B1 | | 2/2001 | Monico |
| 6,213,338 | B1 | | 4/2001 | Cogdill |
| 6,234,364 | B1 | | 5/2001 | Nybakke et al. |
| 6,293,692 | B1 | | 9/2001 | Bowsher et al. |
| 6,367,670 | B1 | | 4/2002 | Warner et al. |
| 6,530,500 | B2 | | 3/2003 | Bravo et al. |
| D510,266 | S | * | 10/2005 | Walsh et al. ..... D9/447 |
| 6,983,862 | B2 | * | 1/2006 | Nottingham et al. ..... 222/109 |
| 2002/0195471 | A1 | | 12/2002 | Nottingham et al. |
| 2003/0102339 | A1 | | 6/2003 | Walsh et al. |
| 2003/0102340 | A1 | | 6/2003 | Walsh et al. |
| 2003/0111489 | A1 | | 6/2003 | Bravo et al. |
| 2003/0121941 | A1 | | 7/2003 | Walsh et al. |

FOREIGN PATENT DOCUMENTS

| | | |
|---|---|---|
| GB | 274542 | 7/1927 |
| GB | 1329741 | 9/1973 |
| GB | 2091677 | 8/1982 |
| GB | 2 284 587 A | 6/1995 |
| JP | 60-240658 | 11/1985 |
| JP | 61-185495 | 8/1986 |
| JP | 63-126258 | 8/1988 |
| JP | 11-506994 | 6/1999 |

* cited by examiner

FIG. 3
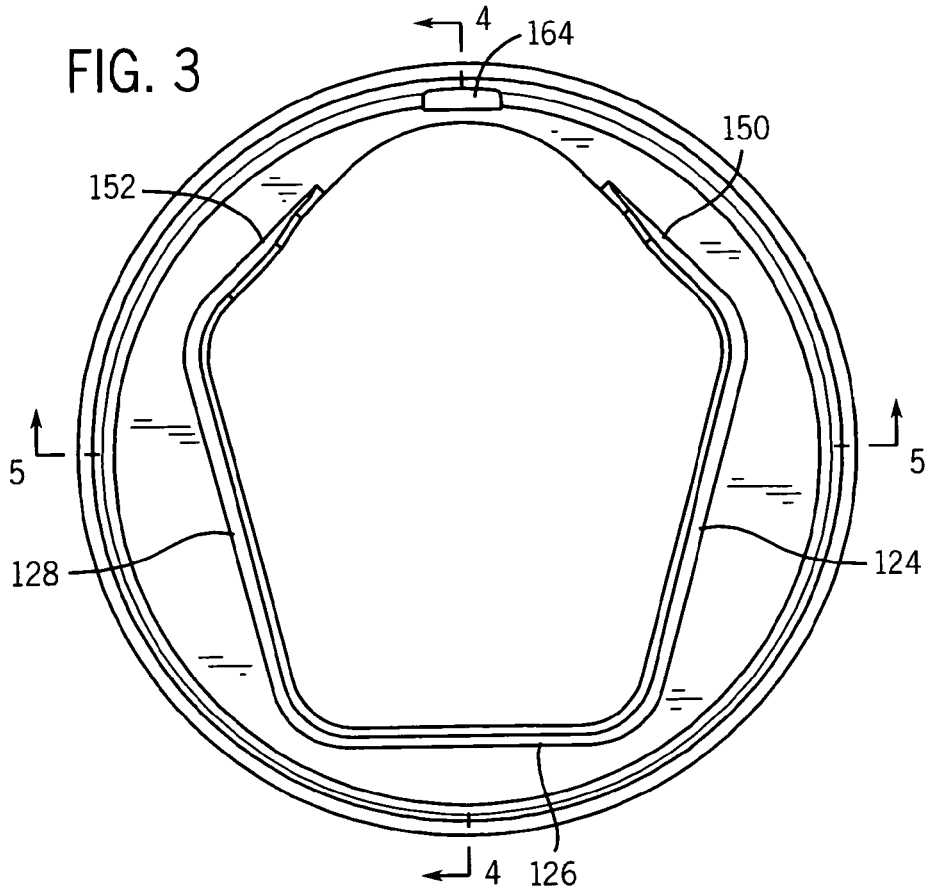
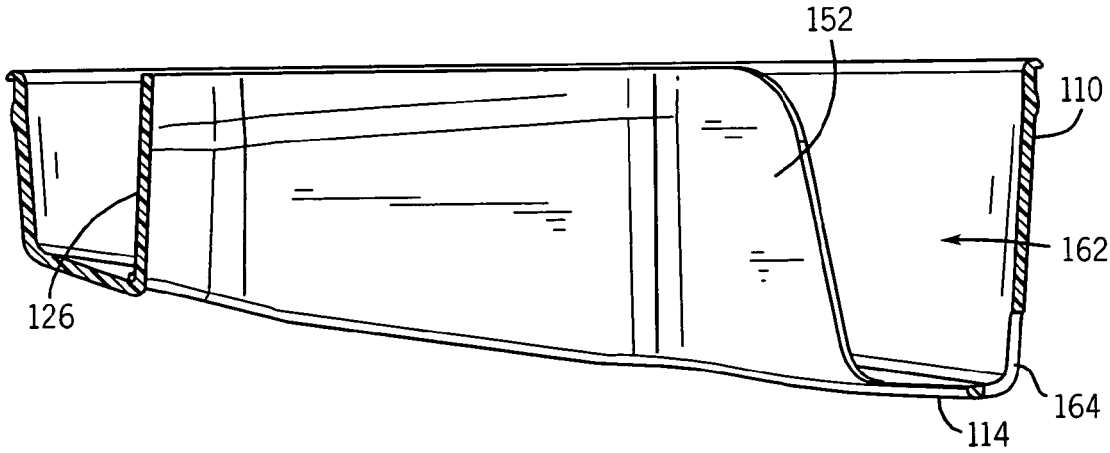
FIG. 4

FIG. 9
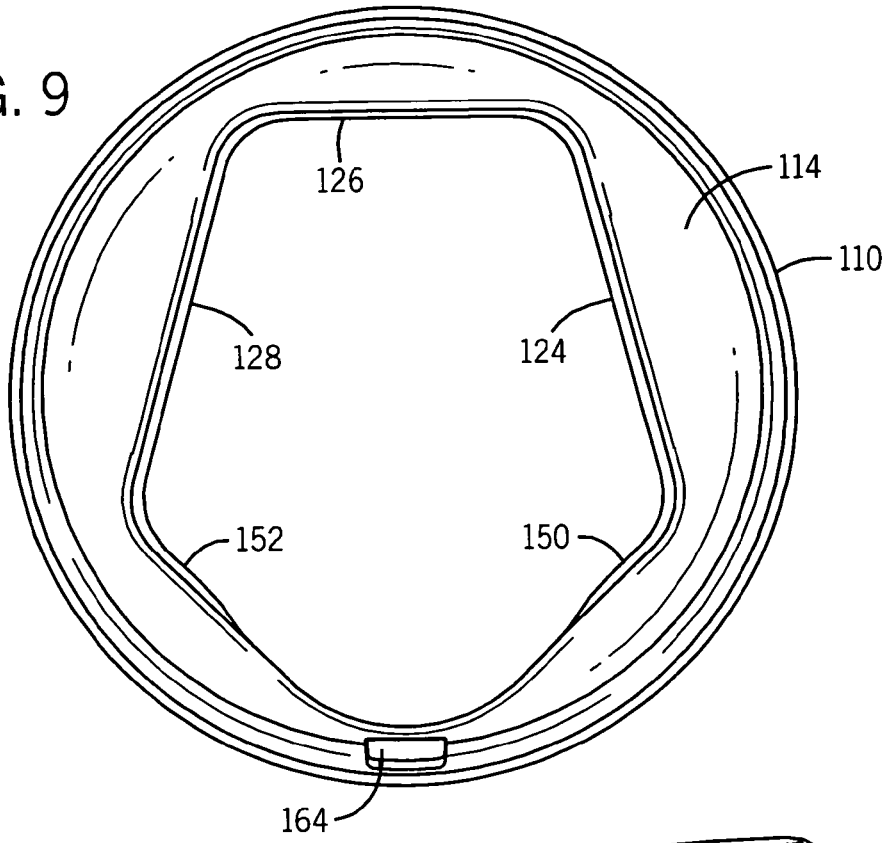
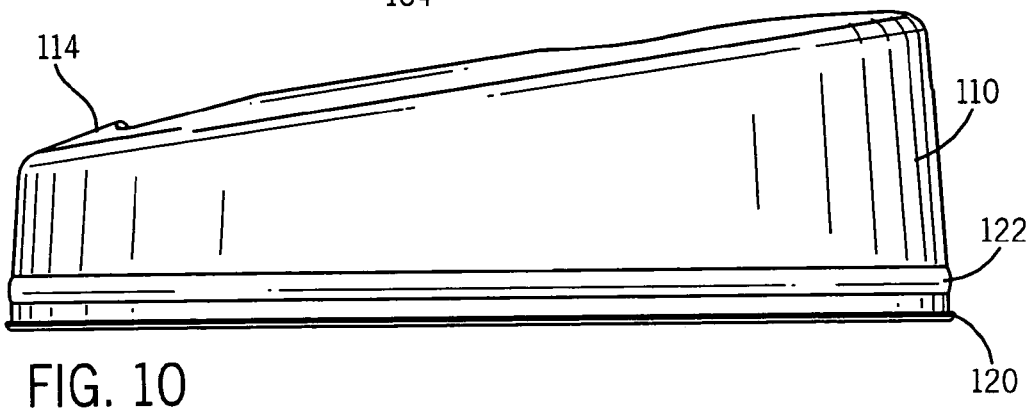
FIG. 10
FIG. 11
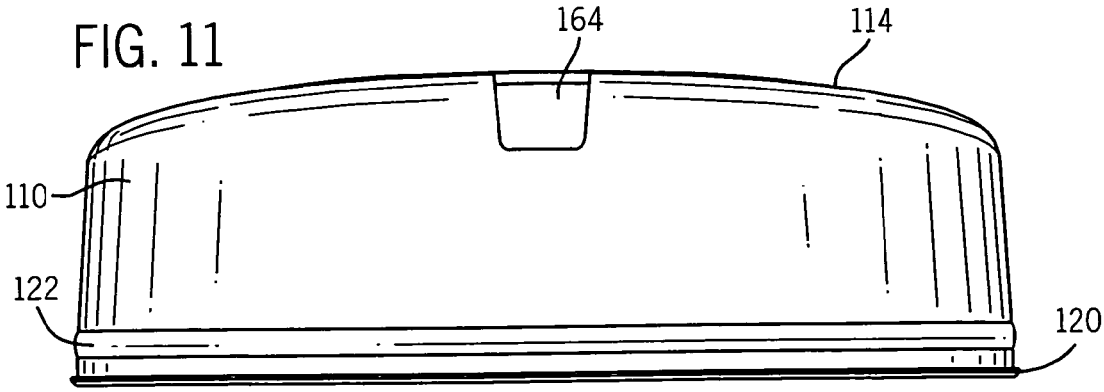

SPOUT

CROSS-REFERENCE TO RELATED PATENT APPLICATIONS

This application is a continuation-in-part of U.S. patent application Ser. No. 10/255,564, filed Sep. 25, 2002 entitled "Container" and incorporated herein by reference, which is a continuation-in-part of U.S. patent application Ser. No. 10/132,682 filed Apr. 25, 2002 now U.S. Pat. No. 7,014,078 entitled "Container" and incorporated herein by reference, which is a continuation-in part of U.S. patent application Ser. No. 10/006,985 filed Dec. 5, 2001 now U.S. Pat. No. 7,036,693 entitled "Paint Container," which is incorporated herein by reference. U.S. Provisional Patent Application No. 60/485,674 filed Jul. 9, 2003 (Manke et al.) entitled "Paint Container" is also incorporated herein by reference.

BACKGROUND OF THE INVENTION

The present invention relates generally to the field of spouts for containers. More specifically, the present invention relates to the field of spouts for containers that are utilized in the distribution, sale, and use of paint.

Typically, paint for application to a house or building for both interior and exterior applications is sold in a cylindrical one gallon metal container. The metal container includes a round base and a cylindrical side wall attached to and extending from the base. The side wall terminates in an upper rim or chime having a u-shaped channel that frictionally receives and engages a plug or lid having a downwardly extending u-shaped annular ring that is frictionally engaged by the walls of the u-shaped channel.

The lid of a conventional paint container is removed by prying the annular ring out of the channel. This is accomplished by using a lever between an outer upper edge of the cylinder and the outer edge of the lid. In order to ensure that the lid does not fall off of the container, the interference/friction fit between the annular ring of the lid and the u-shaped channel of the container is sufficient to require the use of tools to remove the lid. Accordingly, a lever such as a screwdriver is used to pry the lid off of the upper rim by using the edge of the side wall as a fulcrum to apply sufficient force to the outer edge of the lid to remove the annular ring from the u-shaped channel. Depending on the amount of friction that must be overcome, a user usually has to apply pressure at a number of points about the circumference of the lid and container. The repeated insertion of the lever may result in damage to the lid or the coating on the inner surface of the metal lid that is intended to prevent rust or contamination of the paint.

The paint may be poured from the container into a tray or other smaller container to be used by the painter to apply the paint to the intended surface either by brush, pad, roller or other mechanical or electrical system. Almost any time paint is poured, paint drips down the outside of the cylindrical wall and covers any identifying label. If the drips are significant, the paint may streak down the outer edge of the cylindrical wall and drip to the supporting surface that the paint container has been placed on. In any event, a certain amount of paint will be trapped within the u-shaped annular ring of the upper edge of the cylindrical side wall.

When the lid is placed back onto the top of the container, the downwardly extending u-shaped ring on the lid will be soiled by the paint in the annular receiving area of the cylindrical wall. This creates a potential problem the next time the lid is removed and placed on a supporting surface.

The paint on the annular surface may soil the surface upon which the paint lid rests or the hands of the user when they replace the lid again after use. If latex paint is in the container then the latex may dry in the channel and act as an adhesive between the lid and container making subsequent removal of the lid more difficult. The dried paint in the channel may prevent an air tight seal as result of paint buildup preventing the lid from being fully seated within the channel. Further, paint trapped in the channel may be splattered about the room when the lid is replaced and the trapped paint will likely spill over the edge and streak down the side of the container.

Additionally, if the can itself is used as the container from which a brush is dipped by the painter, a significant amount of paint will accumulate in the channel as the brush is removed and excess paint is wiped against the edge of the can. Further, the inner annular edge of the container channel makes it difficult to uniformly wipe paint off of the brush. This results in an uneven application of paint on the brush and on the surface to be painted.

Further the cylindrical container provides other disadvantages in the shipping, display and handling of the container by the end user. First, since the containers are round, the area between the cans represents wasted space when the container are shipped from the factory to the retail outlet. This wasted space must be paid for in terms of shipping costs. Similarly, shelf space at the retail outlet is wasted by the area between the cans. Since the cans are cylindrical, the label must also be cylindrical and therefore does not present the ideal display surface for the consumer at the retail outlet. As the consumer typically walks down the isle, the customer views the container at an angle which reveals only a portion of the label. Many display shelves also permit more than one can to be stacked in a front to back fashion. The cylindrical shape also limits the number of rows of cans that may be stacked on a display shelf.

The handle of the typical paint container is a thin curved wire member comprised of a 0.105 gauge material that digs into the user's hand under the weight of the paint and the container. It is difficult to carry more than one paint container in each hand utilizing the curved wire. Additionally, the curved wire handle requires handle pivot or "ear" supports to be added to the outer surface of the cylindrical can. These pivot supports add assembly and material costs to the container. The pivot supports further affect how the containers must be packed for shipping and for display. Since the pivot supports extend outward from the container, additional space between products or placement such that the pivot supports are in the "dead" space zone between the containers is required.

The cylindrical paint can does not provide a surface to support a paint brush. In order to balance a paint brush on the open container, the brush must be supported by two points on the outer lip. This is most easily accomplished with the bristles balanced at one point and the ferrule or handle balanced at another point. As discussed above, paint often collects in the channel of the container resulting in the ferrule or handle being soiled. Alternatively, if the channel does not contain paint, the placement of the bristles on the edge of the container will likely result in paint dripping into the channel and/or on to the edge of the container, which will likely soil the ferrule or handle if the ferrule or handle is subsequently placed on the soiled region.

Paint that falls into the channel also presents a problem when the lid is being secured to the container after use. The paint in the channel is forced out of the channel as the annular ring of the lid is being located into the channel.

Unless the lid is covered, the paint in the channel will splatter about the room as the lid is securely attached to the container. This result is due to the fact that the lid must be fully seated within the channel and a significant force is required. Typically a rubber mallet is used and the lid is struck a number of times with significant force.

Another problem with the existing paint container is that if the paint is shaken in the container with the lid securely attached, the underside of the lid will become covered with paint and becomes difficult to handle when it is removed from the container.

From the foregoing, it would be desirable to provide a paint container that would minimize shipping costs and permit a maximum number of containers to be stacked on a retail outlet shelf per linear foot of display. It would be further desirable to provide a product and method for displaying a paint product that allows for non-curved labeling. It would be desirable to provide a container that can be positioned correctly on the shelf, and is not easily rotated to a position that makes it difficult for a consumer to see the label. Another feature that would be desirable is a container system that facilitates stacking the containers one in front of the other.

It would also be desirable to provide a container having a paint reclamation pouring mechanism in order to maintain a clean work area. It would also be desirable to provide a paint container that eliminates the need for handle supports or ears on the cylinder. It would also be desirable to provide a handle that is easy for the user to use and does not cut into the user's hand. Additionally, it would be desirable to provide a container with a lid that also serves as a paint container. It would still further be desirable to provide a lid that may be attached securely onto the container without the need for tools. It would also be desirable to provide a container with a spout that provides for a brush to be inserted into the container and includes a non-curved edge to provide for even wiping of the brush. It would further be desirable to provide a spout that facilitates the pouring of viscous materials such as paint. It would also be desirable to provide a spout that may make it easier for a user to remove and replace the cap. It would further be desirable to provide a container that does not permanently dent when dropped or hit. It would also be desirable to provide secure surfaces for a container having one or more of the foregoing features to be employed in shaker equipment, to mix and/or shake the paint. It would be desirable to provide a paint container with the foregoing features alone or in any combination.

SUMMARY OF THE INVENTION

An exemplary embodiment relates to an insert for a container. The insert for a container includes an outer wall, a upstanding spout, and a bottom wall. The outer wall is configured to fit within an opening of the container and defines the periphery of the insert. The outer wall has a lower edge and an upper edge that is disposed at a first elevation. The upstanding spout is located within the outer wall and includes at least one substantially straight portion. The straight portion has a lower edge as well as a substantially straight upper edge that is disposed at a second elevation less than the first elevation. The bottom wall connects the lower edge of the outer wall and the lower edge of the spout to form a channel between the outer wall and the spout.

Another embodiment relates to a container. The container includes a body and an insert. The body defines a partially enclosed volume that has an access opening that is defined by a neck. The insert is coupled to the neck and includes an upstanding peripheral wall, an upstanding spout, and a channel. The upstanding peripheral wall is configured to fit within the neck of the container. The upstanding spout is located within the peripheral wall and includes a first straight portion and a second straight portion. Each of the first straight portion and the second straight portion have a substantially straight upper edge and a substantially straight lower edge. The channel is disposed between the peripheral wall and the spout and includes an aperture for providing access to the volume defined by the body.

A further embodiment relates to an insert for a container that has a body defining a volume as well as a neck defining an opening in the body. The neck of the container has a lower end proximate the body and an upper end distal the body. The insert includes a cylindrical outer wall, a spout, and a bottom wall. The cylindrical outer wall is configured to couple to the neck. The spout is located within the cylindrical outer wall, and includes a first side, a second side, and third side. The first side has a lower edge, a substantially straight upper edge, a first end, and a second end. The second side is coupled to the first end of the first side at an angle with respect to the first side. The second side has an upper edge and a lower edge. The third side is coupled to the second end of the first side at an angle with respect to the first side. The third side has an upper edge and a lower edge. The bottom wall extends between the lower edge of the cylindrical outer wall and the lower edges of the first side, the second side, and the third side to form a channel between the spout and the cylindrical outer wall. The upper edge of the first side of the spout is below the upper end of the neck.

A still further embodiment relates to a container. The container includes a body and an insert. The body defines a partially enclosed volume that has an access opening. The insert is integrally formed with the body and cooperates with the access opening. The insert includes an upstanding peripheral wall, an upstanding spout, and a channel. The upstanding peripheral wall is configured to fit within the access opening. The upstanding spout is located within the peripheral wall and includes a first straight portion and a second straight portion. The first straight portion has a substantially straight upper edge and a lower edge. The channel is disposed between the peripheral wall and the spout and includes an aperture for providing access to the volume defined by the body.

Another embodiment, relates to a paint container. The paint container includes a body, a spout, and a bottom wall. The body includes a top portion, a flat side, and an arcuate side. The top portion has an opening extending therethrough. The spout is coupled to the body and cooperates with the opening in the top portion. The spout is spaced apart from the body and has a first wall with a straight pouring edge proximate the arcuate side of the body. The bottom wall is located between the body and the spout. The body, the spout, and the bottom wall form a channel between the body and the spout.

Alternative exemplary embodiments relate to other features and combinations of features as may be generally recited in the claims.

BRIEF DESCRIPTION OF THE DRAWINGS

FIG. 3 is a top plan view of a spout insert according to an exemplary embodiment.

FIG. 4 is a cross-sectional view of the spout shown in FIG. 3 taken generally along lines A—A.

FIG. 9 is a bottom plan view of the spout shown in FIG. 3.

FIG. 10 is a side view of the spout shown in FIG. 3.

FIG. 11 is a side view of the spout shown in FIG. 3.

DETAILED DESCRIPTION OF THE PREFERRED EMBODIMENTS

Figure 1:
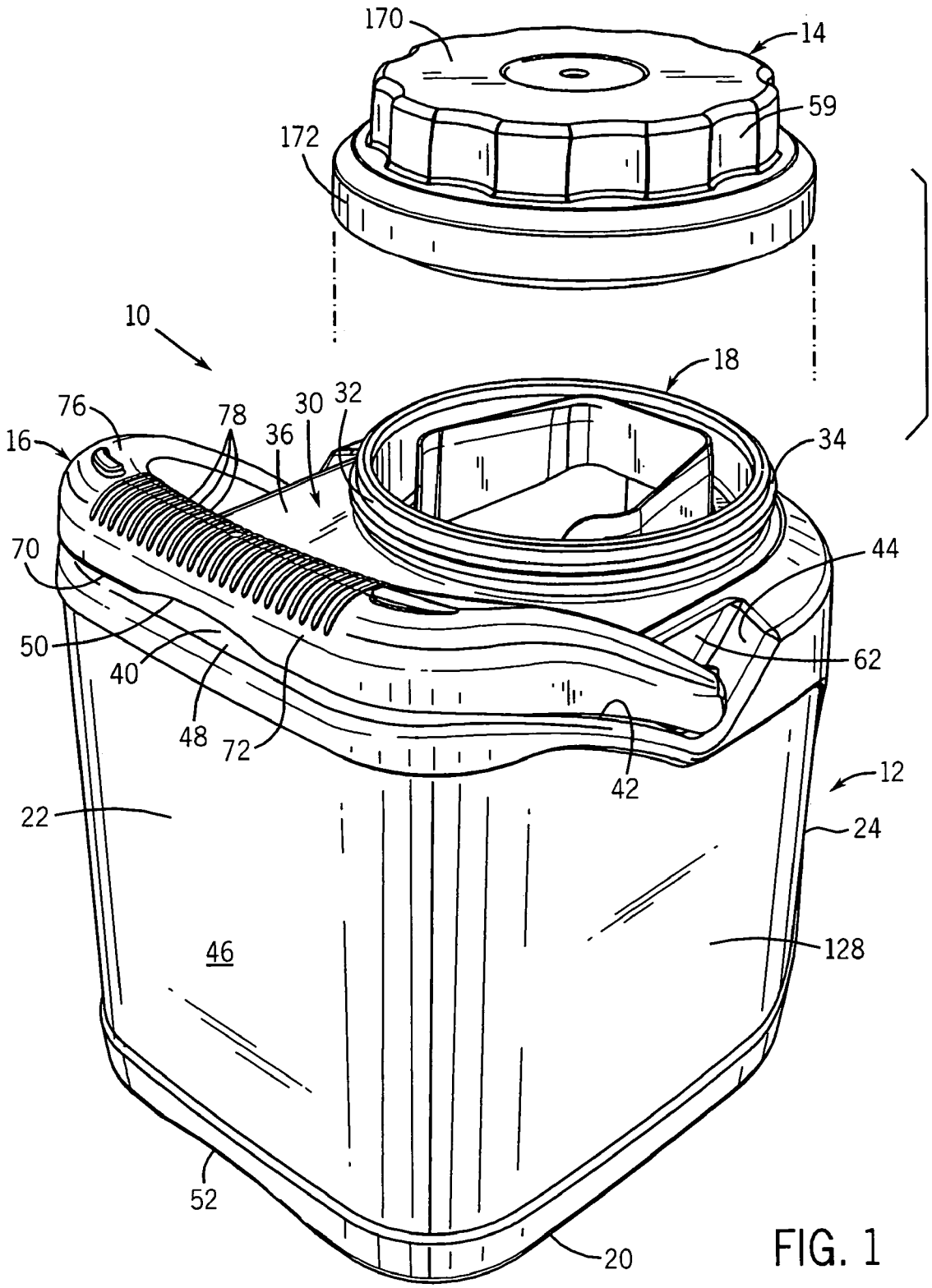
FIG. 1 is a partially exploded perspective view of a paint container according to an exemplary embodiment.
Figure 2:
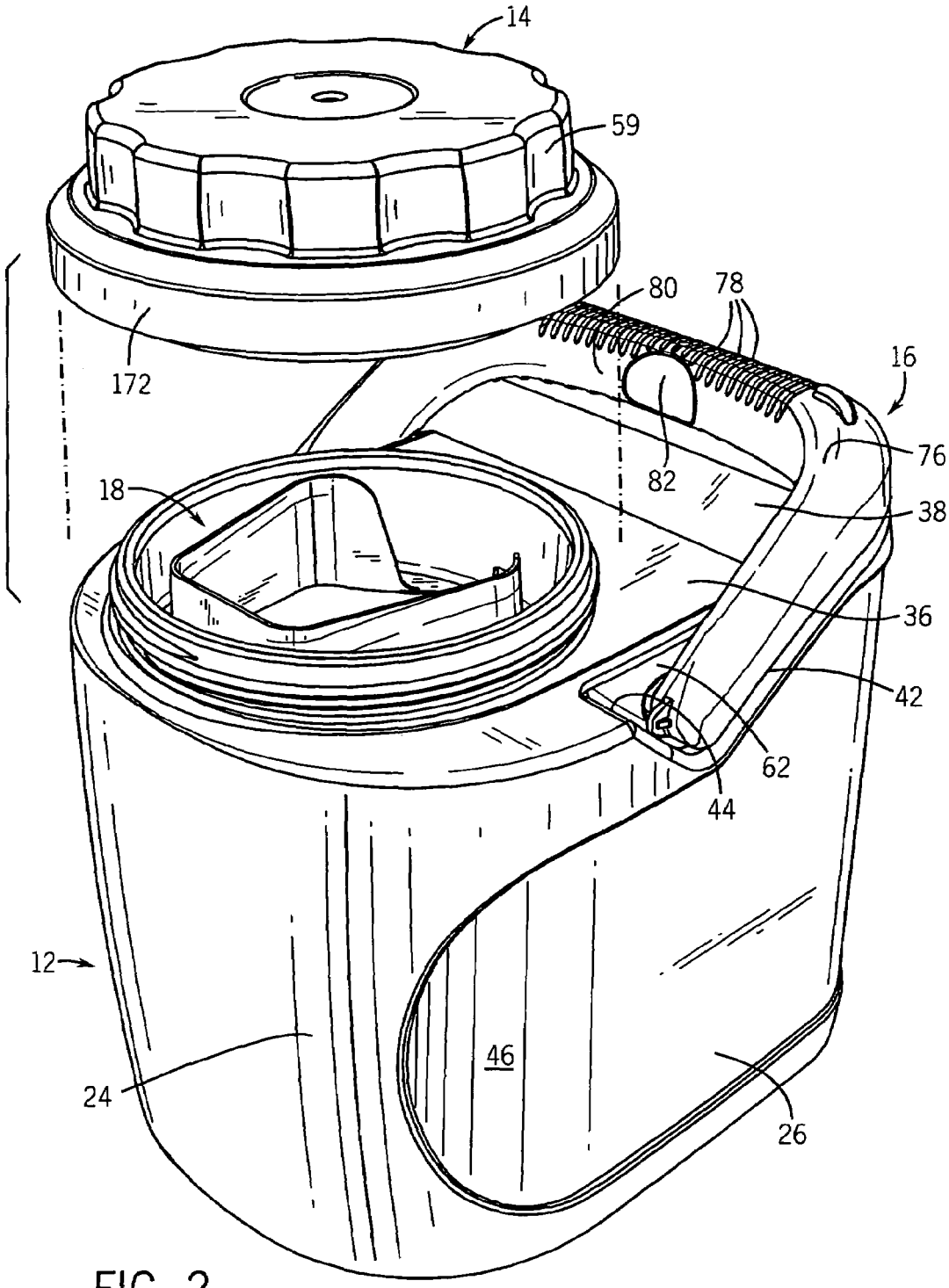
FIG. 2 is a partially exploded perspective view of the paint container illustrated in FIG. 1.
Figure 5:
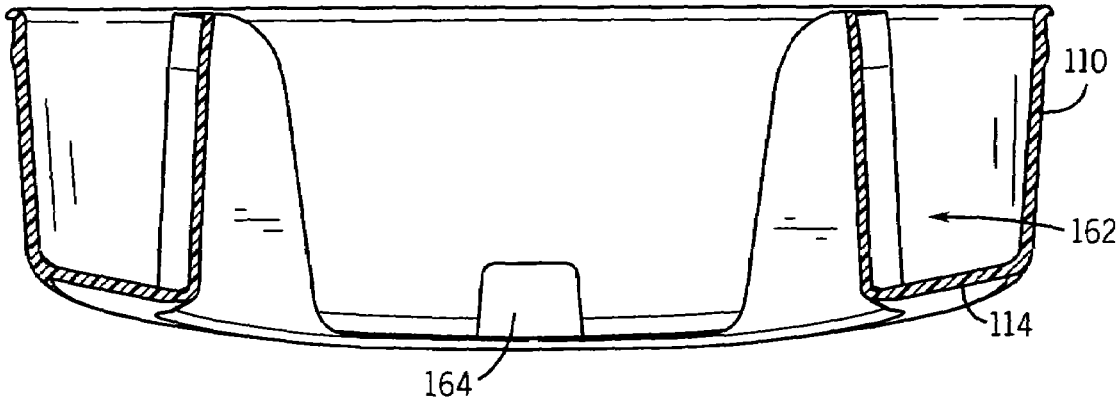
FIG. 5 is a cross-sectional view of the spout shown in FIG. 3 taken generally along lines B—B.
Figure 6:
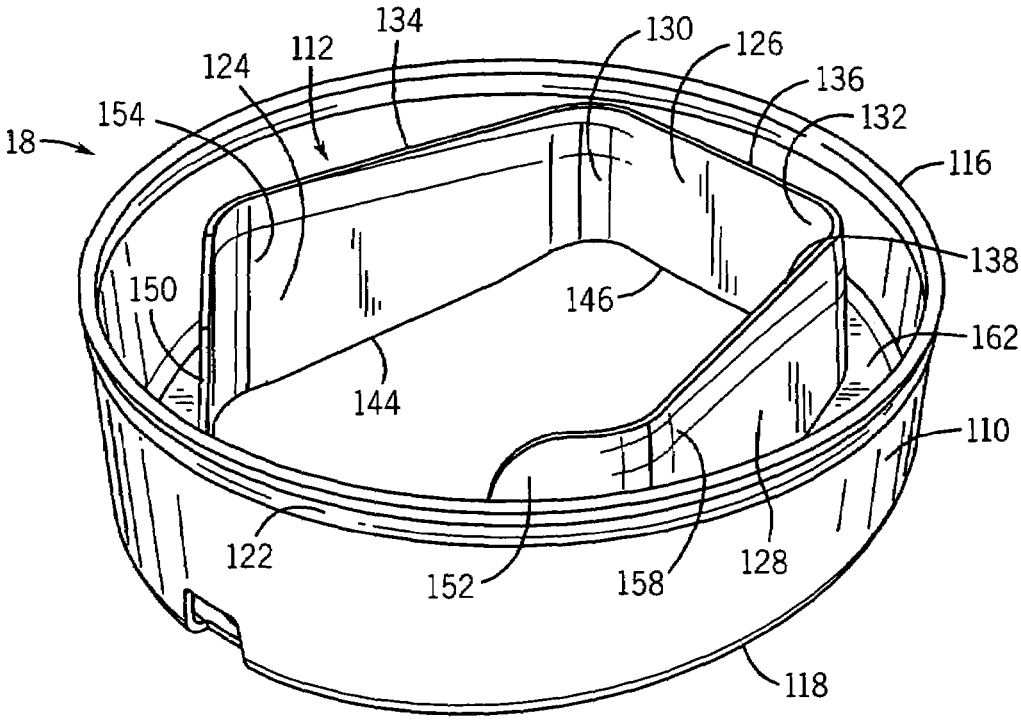
FIG. 6 is a top perspective view of the spout shown in FIG. 3.
Figure 7:
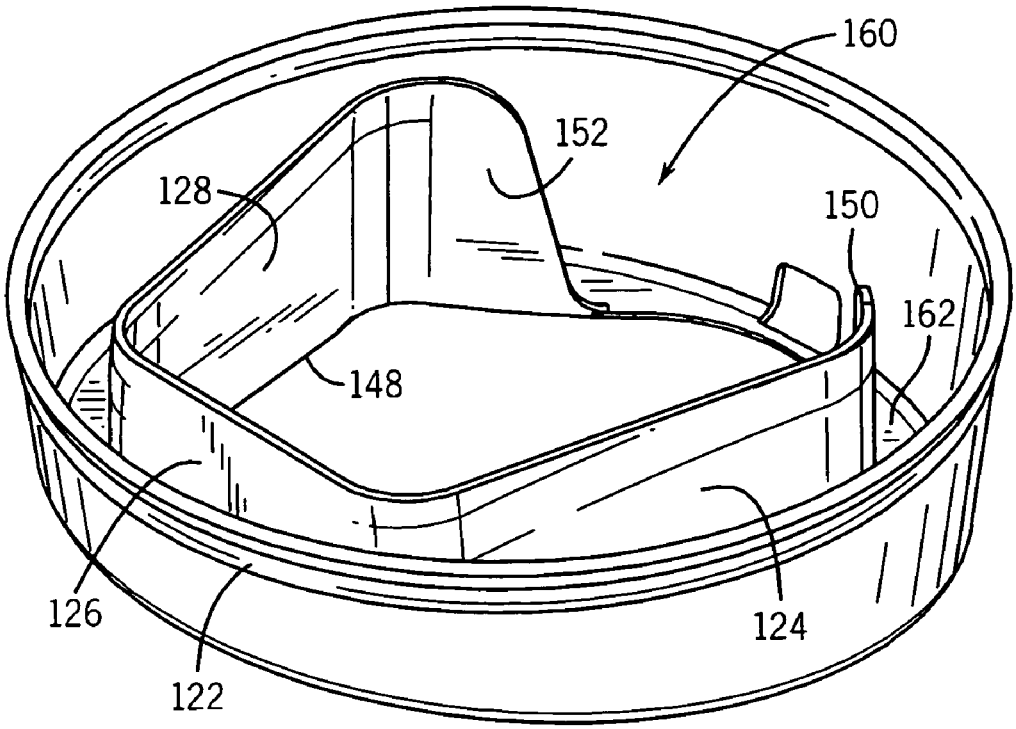
FIG. 7 is a top perspective view of the spout shown in FIG. 3.
Figure 8:
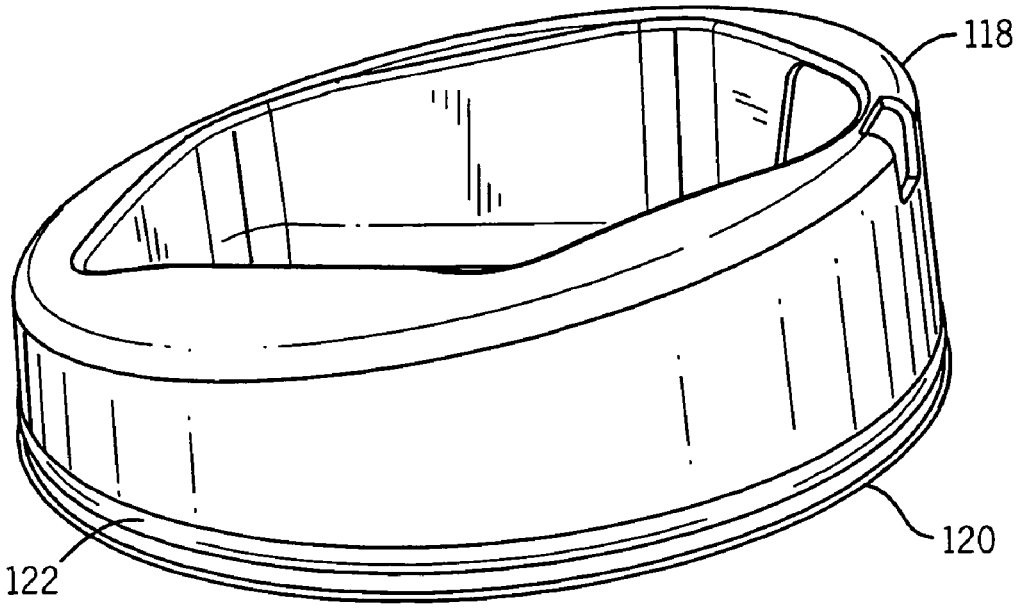
FIG. 8 is a bottom perspective view of the spout shown in FIG. 3.
Figure 12:
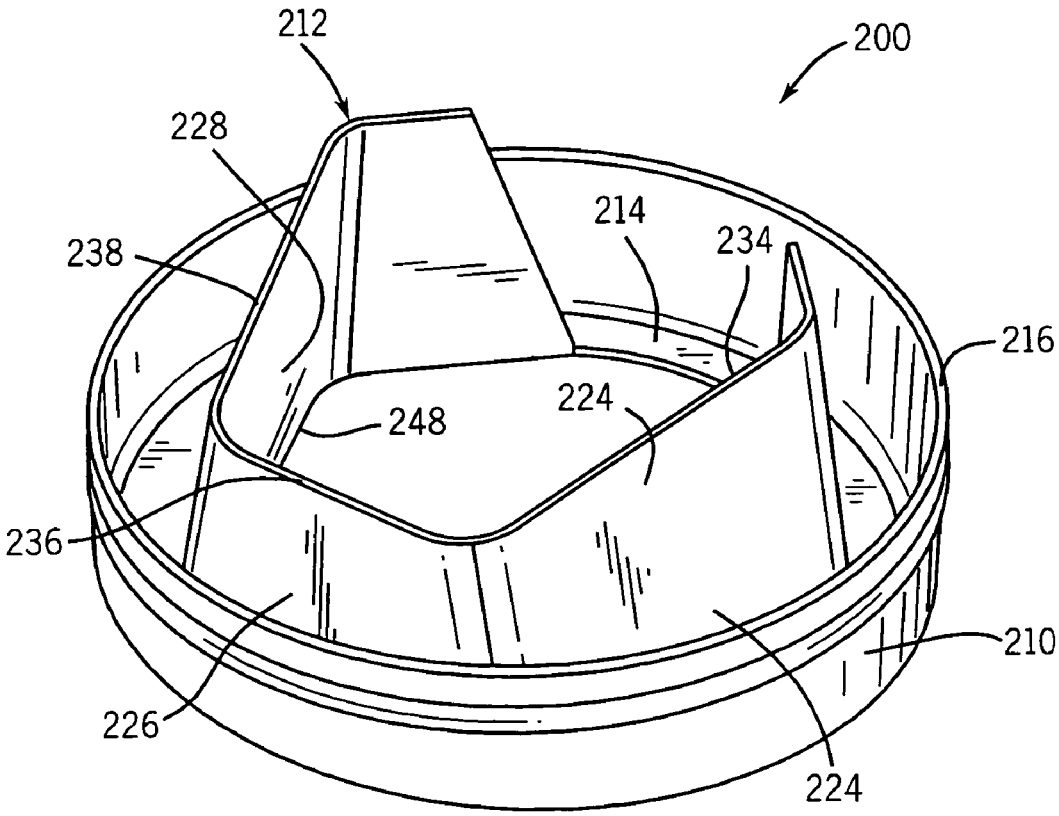
FIG. 12 is a perspective view of a spout according to another exemplary embodiment.
Figure 13:
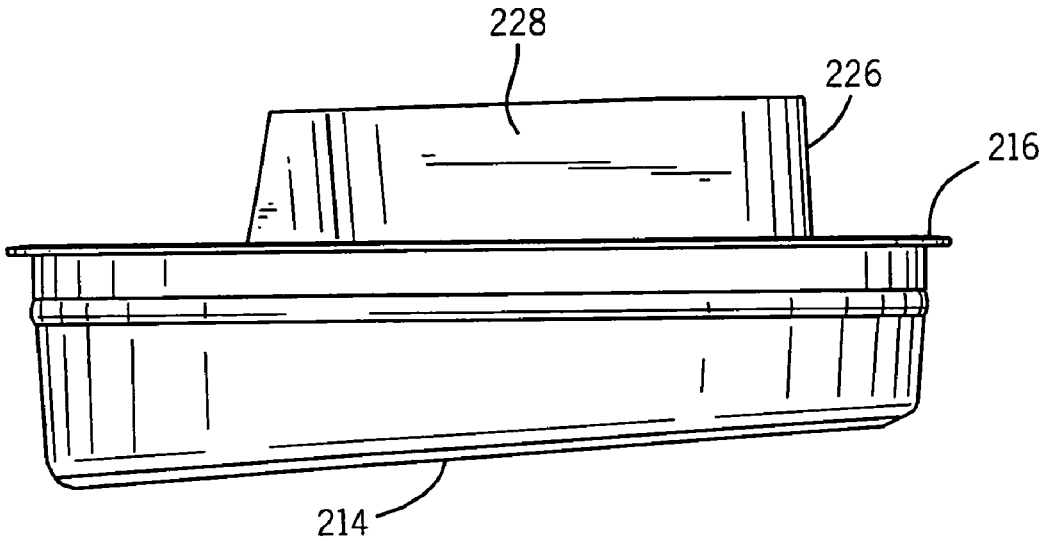
FIG. 13 is a side view of the spout shown in FIG. 12.
Figure 14:
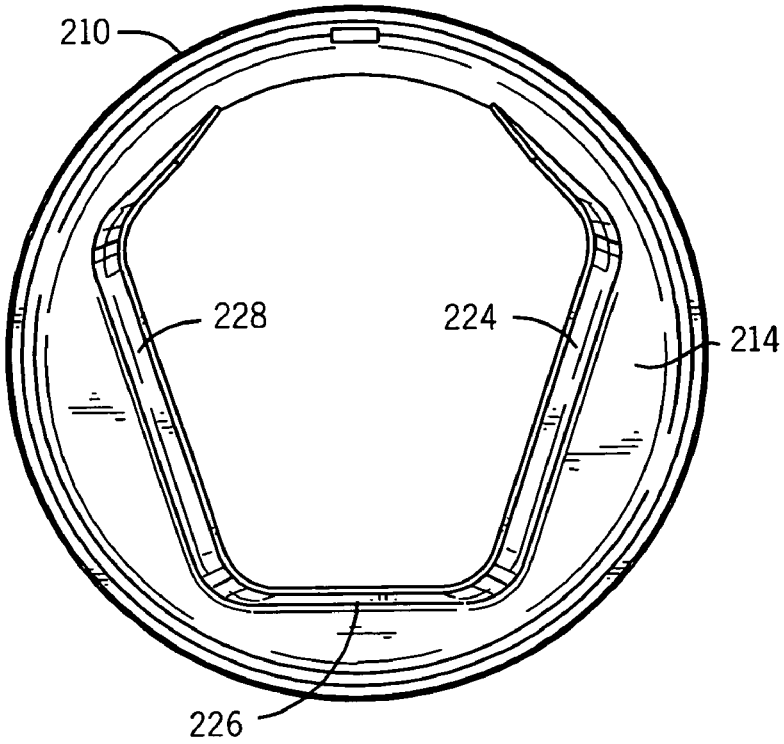
FIG. 14 is a top view of the spout shown in FIG. 12.
Figure 15:
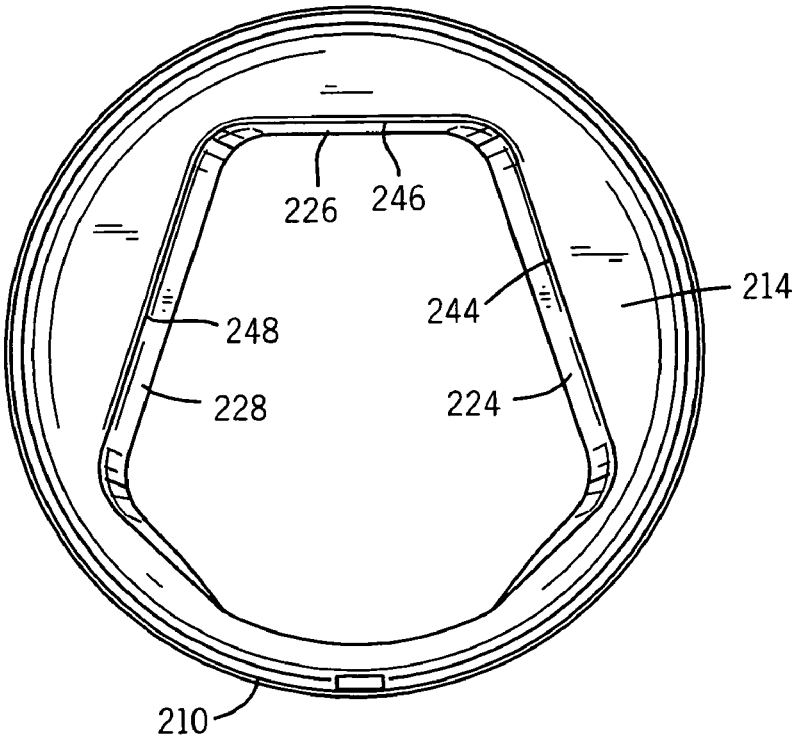
FIG. 15 is bottom view of the spout shown in FIG. 12.

Referring to FIGS. 1 and 2, a container 10 includes a body 12, a cap 14, a handle 16, and a spout insert 18. Body 12 has a general D-shape configuration and includes a bottom 20, a front wall 22, an opposing rear wall 24, and first and second side walls 26, 28. Body 12 also includes a top 30 having a neck 32 provided with external threads 34. The use of the terms front and rear refer to the position that the container may be placed on a retail shelf. While the container may be placed on the retail shelf in any orientation, front wall 22 provides a planar surface for a display label. While the container is in actual use, the location of spout 18 may be considered the front; however, for purposes of this description, spout 18 is closer to back wall 24.

Top 30 also includes a first land region 36 proximate neck 32, a second angled transitional region 38 and an upper region 40 configured to support handle 16. Land region 36 may be flat or parallel to a horizontal plane as illustrated or may have another profile. Adjacent sides 26, 28 and top 30 is a pair of handle support regions 42 that begin lower than first land region 36 and angle upward to transition region 38 and upper region 40. Region 42 as measured from a vertical plane in one embodiment is preferably about 45 degrees. Additionally, a back handle support region 44 as described below supports handle 16 in a rearward position closer to spout 18. Back handle support region 44 as measured from a vertical plane is preferably about 60 degrees. The angle of support region 44 in combination with the size of handle 16 prohibits handle 16 from contacting spout 18 or the rear portion of body 12, and still provides clearance over cap 14 to lift handle 16. Accordingly, other angles of region 44 may be used.

Body 12 also includes a recessed region 46 that extends across the substantially flat front wall 22 and around at least a portion of the curved back wall 24. Recessed region 46 may receive a label that could be applied during the forming operation such as in-mold labeling for a plastic formed component. A label may also be applied to the container after the container has been formed.

A front edge 48 of upper support region 40 may be curved or beveled as a transition into front wall 22. This transition edge 48 provides an easy surface for a user to be able to grasp handle 16. While the front edge 48 may have a recessed region permitting a user to slide his fingers under the handle, handle 16 may also include a handle recess 50 either in addition to a recess on edge 48 or independent of such a recess. A disruption in the interface between handle 16 and top 30 and front wall 22 allows a user to easily grasp and raise handle 16.

A bottom recess 52 is located on the bottom edge of container 10 between front wall 22 and bottom 20. Bottom recess 52 allows a user to reach under the bottom of container 10 while container 10 is resting on a supporting surface or on another container 10. Bottom recess 52 further facilitates pouring paint from container 10. Bottom recess 52 is connected to a finger recess or well (not shown) extending inwardly into container 10 from bottom 20. The finger recess may be located immediately proximate bottom recess 52 or may be connected to bottom recess 52 with a recess channel (not shown). Bottom recess 52, the recess channel, and the finger recess may be configured to comfortably rest on a user's hand to aid the user in pouring the content from the container. While one hand is holding handle 16, a second hand may be grasping the bottom by use of the bottom recess 52, the finger recess, and the recess channel either together or in any combination of these features.

The height of bottom recess 52 as measured from a support surface of the container, or as measured from the lowest support features on bottom 20, may be sufficient to allow a user to insert his fingers or portion of his finger in the bottom recess, the channel recess, and/or the finger recess. This would allow a user in combination with the handle to easily lift the container from a support surface such as a retail outlet shelf, table or another container.

Bottom 20 may also include a cap recess (not shown) that is configured to receive a portion of cap 14 when like containers 10 are stacked on one another. The cap recess may include a periphery having features that match those of cap 14 such as indentations to match recesses 59 that are provided on cap 14. Alternatively, the cap recess may have an outer diameter that matches or exceeds the outer diameter of cap 14.

According to a preferred embodiment, body 12 includes a pair of handle recesses that extend into a handle support wall 62 adjacent first region 36 and support region 42. The handle recesses are configured to frictionally receive a pair of trunnions or tabs that extend inwardly from handle 16. Of course, the container may include a pair of tabs extending outwardly that would be received within a pair of recesses on the handle. The tabs and recesses allow handle 16 to pivot from a first rest position in which the handle 16 is proximate front wall 22 to an in-use position to a fully forward position in which handle 16 rests against handle support surface 44. The friction or interference fit between the handle recess and the trunnions allows a user to place the handle in a preferred position and have the handle remain in that position unattended. Additionally, when the cap is off the body of the container, the frictional fit will keep the handle from moving toward the spout area. Support surface 44 further ensures that even if handle 16 is pushed toward rear wall 24, it will not fall completely in front of the pouring edge of spout 18. Further, the friction or interference fit of the handle recesses and the trunnions also resists movement of the legs of handle 116 from spreading outwardly that could result in the trunnions being dislodged from the recesses. In this manner, handle 16 remains attached to body 12 even when handle 16 is supporting the full weight of the paint in container 10. In a preferred embodiment, container 10 is blow molded from plastic.

Referring still to FIGS. 1 and 2, handle 16 includes a lower surface 70 having substantially the same profile as handle support region 42, transition region 38 and upper region 40 of body 12. As discussed above, handle 16 includes a recess 50 extending upward into the bottom of handle 16 into a front surface 72 to provide a recess for a user to easily lift handle 16 from the upper surface 40 of the container. Handle 16 includes a honeycomb structure including a plurality of ribs to provide strength and rigidity to the handle. Of course, a solid handle may also be used, however this adds cost and weight to the product. The handle may be plastic injection molded. The exterior surface of handle top 76 includes a ribbed pattern 78 to provide a gripping surface for the user. Ribbed pattern 78 may be formed from a softer material to provide additional comfort to the user. Handle 16 also includes a rear surface 80. When a user holds container 10 with handle 16 in the vertical position, the rear surface 80 rests on the portion of a user's hand that is bearing the majority of the weight of container 10. The honeycomb structure of handle 16 rests against the tip of the user's fingers on an area that is not bearing the majority of the weight of the container. As illustrated in FIG. 2, handle 16 includes a recess 82 extending inwardly into rear surface 80. Recess 82 provides a central position for container 10 to hang from a hook, nail or other support structure. Recess 82 hampers container 10 from sliding along rear surface 80 when the container is being supported by a hook attached to a support surface such as a ladder. Handle 16 may also include an aperture extending into a central portion of the handle configured to receive a hook or other member for hanging the container.

In one preferred embodiment, the clearance between a center region of handle 16 proximate handle recess 50 and support recess 82 and the top of cap 14 is one inch when handle 16 is substantially vertical. When top portion 76 of the legs of U-shaped handle 16 is adjacent handle support surface 44, the clearance between the center region of handle 16 and the top of cap 14 is 0.5 inches. Of course, other clearances may be designed, however, there should be sufficient clearance to allow a user to freely carry and pour the paint from the container.

The width of handle support regions 42 and 44 are at least as wide as handle 16 so that the outer periphery of handle 16 does not extend beyond the outer periphery of body 12. Similarly, the pivot connection of handle 16 is located such that front surface 72 of handle 16 does not extend beyond front wall 22.

Handle 16 further includes two raised tabs 90 that have the same height from bottom 20 as does the top of cap 14, when cap 14 is threadably attached to neck 32 of body 12. The bottom 20 includes two stacking recesses (not shown) that are configured to receive tabs 90 of handle 16. This provides a positive locator for stacked containers 10 as well as stability to stacked containers 10. Tabs 90 extend in both the cross container direction and fore/aft direction resulting in a positive location in both directions. However, tabs 90 and/or the stacking recesses could be configured to constrain the stacked container in a single direction.

Referring to FIGS. 3–11, spout insert 18 includes an outer wall 110, a spout 112, and a bottom wall 114. Outer wall 110 is configured to slide into neck 32 and includes features (described below) to hold insert 18 within neck 32. According to a preferred embodiment, outer wall 110 is a substantially cylindrical wall that defines the periphery of spout insert 18 and that includes an upper edge 116 and a lower edge 118. A small lip 120 extends radially outwardly from upper edge 116, and serves as a stop to prevent insert 18 from being pushed too far into, or through, neck 32. A radially outwardly extending protrusion 122 extends around the periphery of outer wall 110, and is configured to engage a corresponding groove (not shown) provided on the inside of neck 32. The engagement of protrusion 122 and the corresponding groove serves to hold spout 18 into the proper position with respect to container 10. According to alternative embodiments, the outer wall may include other features to prevent the insert from being pushed too far into the neck of the container and/or to hold the insert in the neck. For example, the insert may include threads on the outer wall that engage threads provided on the inside of the neck when the insert is screwed into the neck. The insert may also be coupled to the neck using a frictional-type fit, spin-welding, adhesives, or any of a wide variety of other techniques and methods known in the art.

Spout 112 is provided within the periphery of insert 18 (e.g., spout 112 is inside of, and spaced apart from, outer wall 110) and is generally configured to facilitate the pouring of the contents (e.g., paint or other fluids) from container 10. According to a preferred embodiment, spout 112 includes a first wall or side 124, a second wall or side 126, and a third wall or side 128. Each of walls 124, 126, and 128 are substantially flat panels that have the same general orientation as outer wall 110 (e.g., each of walls 124, 126, and 128 lies in a plane that is substantially parallel to the central axis of cylindrical outer wall 110). Walls 124, 126, and 128 are coupled together in a partial trapezoidal configuration, with wall 126 forming the shorter of the two parallel sides of the trapazoid and walls 124 and 128 forming the two non-parallel sides of the trapaziod that connect the two parallel sides. Accordingly, wall 124 is coupled to end 130 of wall 126 and wall 128 is couple to end 132 of wall 126. Walls 124 and 128 extend from the ends 130 and 132 of wall 126, respectively, at generally equal obtuse angles. Walls 124, 126, and 128 each have straight upper edges 134, 136, and 138, respectively, over which the contents of container 10 (e.g., liquid coating materials such as paint, varnish, etc.; water; liquids; or other substances) are poured when the contents of container 10 are removed using spout 112. Straight upper edges 134, 136, and 138 may also be used as brush wipes to wipe excessive paint off of a brush. Upper edges 134, 136, and 138 define the height or elevation of walls 124, 126, and 128, which maintain a generally constant height or elevation along their lengths. Each of walls 124, 126, and 128 also have straight lower edges 144, 146, and 148, respectively, that define the bottom of spout 112. The elevation or height of upper edges 134, 136, and 138 is approximately equal to, or slightly less than, the height of upper edge 116 of outer wall 110 and the upper edge of neck 32.

In addition to walls 124, 126 and 128, spout 112 includes walls 150 and 152 that extend from ends 154 and 158 of walls 124 and 128, respectively. The height of walls 150 and 152 reduces as walls 150 and 152 extend away from wall 124 and 128, respectively, until walls 150 and 152 terminate. Walls 150 and 152 terminate before intersecting one another and thereby leave a gap 160 in spout 112 opposite wall 126. The function of gap 160 will be described in further detail below.

Bottom wall 114 extends between outer wall 110 and spout 112 and serves to couple lower edge 118 of outer wall 110 with lower edges 144, 146, and 148 (and the lower edges of walls 150 and 152). A channel 162 is thereby formed by outer wall 110, bottom wall 114, and spout 112 that extends around insert 18 between outer wall 110 and spout 112. An aperture 164 is provided in channel 162 (partially in bottom wall 114 and partially in the lower portion of outer wall 110) at a location opposite wall 126. Aperture 164 is configured such that substances (such as paint, for example) that enter channel 162 can pass through aperture 164 and drain back into body 12 of container 10. In order to direct any substances that my enter channel 162 toward aperture 164, channel 162 slopes toward aperture 164. To enable channel 162 to slope toward aperture 164, lower edge 118 of outer wall 110; lower edges 144, 146, and 148 of walls 124, 126, and 128, respectively; and bottom wall 114 are also sloped as needed to allow channel 162 to slope toward aperture 164.

As shown in FIGS. 1 and 2, spout insert 18 is preferably coupled to container 10 in such a way that wall 126 is proximate back wall 24 of body 12 (e.g., such that wall 126 is the back most portion of spout 112). In such a configuration, a user of container 10 may grasp handle 16 with one hand and the bottom of container 10 (more particularly, bottom recess 52, the finger recess, and/or the recess channel) with the other hand and pour paint (or other material contained within body 12) from spout 112 over straight upper edge 136 and over back wall 24 of container 10. Once container 10 is returned to an upright position, any paint that may have entered channel 162 (such as during pouring or while wiping a paint brush against one of the straight edges of spout 112) will flow toward aperture 164 and pass back into body 12 of container 10. Channel 162 thereby reduces the likelihood that excess paint will drip down the side of container 10, which may hamper the ability to read any label that may be provided on container 10 and which may allow paint to get on surfaces for which the paint was not intended. Gap 160 provided in spout 112 may also serve to allow paint that enters channel 162 to pass back into body 12. If one desires to use the paint directly from container 10, the user may simply apply paint to his or her paint brush by inserting the paint brush into body 12 between walls 124, 126, and 128 (as well as walls 150 and 152) of spout 112. Straight upper edges 134, 136, and 138 can then be used to wipe any excess paint from the brush. When finished using the paint, the user simply replaces cap 14. With upper edges 134, 136 and 138 of walls 124, 126, and 128, respectively, no higher than upper edge 116 of outer wall 110 and/or the upper edge of neck 32, cap 14 may be easier to replace and any excess paint that may be on the outside of walls 124, 126, and/or 128 is less likely to be transferred to cap 14 when cap 14 is screwed onto container 10.

Referring to FIGS. 12–15, a spout insert 200 is shown according to another exemplary embodiment. Spout insert 200 includes an outer wall 210, a spout 212, and a bottom wall 214. Outer wall 210 and bottom wall 214 are substantially similar to outer wall 110 and bottom wall 114 described above in relation to spout insert 18. Spout 212 also has features similar to the features of spout 112. For example, spout 212 includes a first wall or side 224, a second wall or side 226, and a third wall or side 228 coupled together in the same manner as walls 124, 126, and 128 of spout 112. Moreover, walls 224, 226, and 228 each have straight upper edges 234, 236, and 238, respectively, over which the contents of container 10 (e.g., paint, water, liquids, or other substances) are poured when the contents of container 10 are removed using spout 212. Upper edges 234, 236, and 238 define the height or elevation of walls 224, 226, and 228, which maintain a generally constant height or elevation along their lengths. Walls 224, 226, and 228 also have straight lower edges 244, 246, and 248, respectively that define the bottom of spout 212. Spout 212 differs from spout 112 in that the elevation of walls 224, 226, and 228 is greater than the elevation or height of an upper edge 216 of outer wall 210 and/or the upper edge of neck 32.

Referring to the Figures the spout includes a second and third substantially straight portion extending from opposite sides of a first substantially straight portion. Each of the second and third portions have a substantially straight upper edge having a second length greater than the first length of the first substantially straight portion. In one embodiment, the spout includes a first straight portion with a first length and a second and third straight portion having a second length that is greater than the first length. The spout also includes a second and third straight portion having a second length greater than the first length. The second and third substantially straight portions extend from opposite sides of the first substantially straight portion. In another embodiment, the spout includes a first side, second side and third side. Each of the sides includes a straight upper edge. The straight upper edges of the second and third side extend from the first side and through a center line extending perpendicular to the cylindrical wall and parallel to the straight upper edge of the first side.

According various alternative embodiments, the spout insert may take any one of a plurality of different configurations. For example, any one or more of the walls of the spout may extend vertically upward or may be angled either toward or away from the center of the spout as they extend upwardly. Furthermore, the upper edges of the walls may have the same elevations, or they may different elevations. Moreover, the elevation of the upper edge of any one or more of the walls of the spout may vary along the length of the wall, or it may be constant. For example, the upper edge of one or more of the spout walls may be level or it may have an increasing or decreasing elevation. The walls may also be configured such that the upper edge of the spout, as a whole, is level or such that it increases and/or decreases in elevation. Additionally, the elevation of the walls of the spout may vary with respect to the height of the outer wall or with respect to the height of various parts of the container. Thus, the upper edge of one or more of the spout walls may extend above, below, or be even with the upper edge of the outer wall, the upper edge of the neck of the container, and/or the edge of some other feature of the container. According to still other alternative embodiments, the lower edge of any one or more of the spout walls may be straight, curved, arced, or may have some other shape. Moreover, the length of any one or more of the spout walls may vary. The overall size and shape of the spout may also vary. For example, the spout may be configured to allow a variety of different sized paint brushes to pass through the spout and into the body of the container. According to another alternative embodiment, any one or more of the upper edges of the walls of the spout may have a comb-like configuration intended to comb excess paint from paint brushes. According to another alternative embodiment, the spout insert may be integrally-formed with the container. According to yet another alternative embodiment, the spout insert may not include an outer wall or a channel, but rather, may be comprised of one or more walls coupled together to form a spout. According to still other alternative embodiments, the spout insert may include only one of the aperture provided in the channel and the gap provided in the spout. According to other alternative embodiments, the transition between one or more of the walls of the spout may be a sharp, distinct corner; it may be radiused; it may be tapered or beveled; or it may have some other gradual or abrupt transition. According to other alternative embodiments, the container may include an opening on a side other than its top side and may include a spout insert within such opening. It should be noted that references to "upper," "lower," "top," "bottom," "height," and/or "elevation" refer to certain portions, positions and/or dimensions of the spout (and other parts of the container) as they would appear when the container is placed as intended on a retail shelf. However, it should be understood that these references apply equally to spout inserts (and other parts of the container) that are oriented differently. Thus, the "elevation" of the upper edge of a spout that extends horizontally out of the side of a container would be the same as the "elevation" of an identical spout extending vertically from the top of a container.

Referring now to FIGS. 1 and 2, cap 14 serves both as a cover and a paint dish. Cap 14 includes a downwardly extending wall that extends from the top 170 of cap 14 between outer wall 110 and spout 112 of spout insert 18. Cap 14 further includes an outer wall 172 having internal threads that threadably engage the outer threads 34 of neck 32. Cap 14 may also include an indentation or recess on the top of the cap that receives a molded in logo and/or a dab of paint allowing the user to identify the color of the paint by the color of the dab of paint on the lid. The dab of paint could be on a white or colored sticker placed in the recess or detent on the top of the cap. In one embodiment, the diameter of the cap is four inches and includes a plurality of detents or undulations to permit a user to easily grip and rotate the cap.

Further modifications may be made in the design, arrangement and combination of the elements without departing from the scope of the invention as expressed in the appended claims. For example, a top member including one or more of the features discussed above such as the spout, reclamation structure or channel, and others may be integrally formed with the body member or may be fastened to the container as a separate component. Additionally, the container may include transparent areas to allow the user to see the contents of the container. Further, the cap attachment may include a transparent area to indicate whether the cap is securely attached to the container to prevent paint from accidentally being spilled. Although the container has been referred to as a paint container, other liquids may be stored and poured as well. While some of the features have a unique application to the storage and application of paint, other features may be used for other liquids as well. Additionally, the label that is applied to the container may include a blank white portion to permit the user or manufacturer to dab or paint a sample of the paint in the container to clearly show what color is contained within the container and how it will appear when painted on a white background. It is also noted that the features described in the specification and shown in the Figures either alone or in combination may also be combined with individual or multiple features disclosed herein or in the priority applications noted above. These and other modifications may be made in the design, arrangement and combination of the elements without departing from the scope of the invention as expressed in the appended claims.

What is claimed is:

1. An insert for a container, comprising:

an outer wall configured to fit within an opening of the container and defining the periphery of the insert, the outer wall having an upper edge and a lower edge, the upper edge being disposed at a first elevation;

an upstanding spout located within the outer wall, the spout including a first substantially straight portion, the first straight portion having a lower edge and a substantially straight upper edge having a first length, the upper edge of the spout being disposed at a second elevation greater than the first elevation; and a bottom wall connecting the lower edge of the outer wall and the lower edge of the spout to form a channel between the outer wall and the spout;

the spout including a second and third substantially straight portion extending from opposite sides of the first substantially straight portion, each of the second and third portions having a substantially straight upper edge having a second length greater than the first length of the first substantially straight portion.

2. The insert of claim 1, wherein the outer wall is circular.

3. The insert of claim 1, wherein the second and third substantially straight portions extend through a center portion of the insert, the first portion being located on a first side of the opening, the second portion, the opening having a center line with the first portion being on one side of the center line, and the second and third portions extending from the first across the center line; the center line being substantially parallel to the first portion.

4. The insert of claim 3, wherein the elevations of the upper edges of the three substantially straight portions are equal.

5. The insert of claim 3, wherein each of the three substantially straight portions has a lower edge and wherein the lower edge of at least one of the three substantially straight portions gradually changes elevation along the length of the lower edge.

6. The insert of claim 1, wherein the channel includes an aperture.

7. The insert of claim 6, wherein the channel is sloped toward the aperture.

8. The insert of claim 1, wherein the insert has a front side and a back side corresponding to a front side and a back side of the container, and wherein the at least one straight portion is provided on one of the front side and the back side of the insert.

9. A container, comprising:

a body defining a partially enclosed volume having an access opening defined by a neck; and an insert coupled to the neck, the insert comprising:

an upstanding peripheral wall configured to fit within the neck of the container;

an upstanding spout located within the peripheral wall, the spout including a first straight portion with a first length and a second and third straight portion having a second length greater than the first length, each straight portion having a substantially straight upper edge and a substantially straight lower edge, the second and third substantially straight portions extending from opposite sides of the first substantially straight portion; and a channel disposed between the peripheral wall and the spout, the channel including an aperture for providing access to the volume defined by the body.

10. The container of claim 9, wherein the neck has a lower edge proximate the body and an upper edge distal the body, the upper edge of the neck being a first distance from the body.

11. The container of claim 10, wherein the upper edge of the first straight portion is a second distance from the body.

12. The container of claim 11, wherein the second distance from the body is less than the first distance from the body.

13. The container of claim 9, wherein the elevation of the upper edge of the first straight portion is equal to the elevation of the upper edge of the second straight portion.

14. The container of claim 9, wherein the channel slopes toward the aperture.

15. The container of claim 9, wherein the second straight portion and the third straight portions are coupled to the first straight portion at an angle.

16. The container of claim 15, wherein the angle is obtuse.

17. The container of claim 15, wherein the angle at which the second straight portion is coupled to the first straight portion is the same as the angle at which the third straight portion is coupled to the first straight portion.

18. The container of claim 9, further comprising a liquid coating material disposed within the volume defined by the body.

19. An insert for a container having a body defining a volume and a neck defining an opening in the body, the neck having a lower end proximate the body and an upper end distal the body, the insert comprising:

a cylindrical outer wall configured to couple to the neck;

a spout located within the cylindrical outer wall, the spout comprising:

a first side having a lower edge and a substantially straight upper edge and having a first end and a second end;

a second side coupled to the first end of the first side at an angle with respect to the first side, the second side having a straight upper edge and a lower edge; and a third side coupled to the second end of the first side at an angle with respect to the first side, the third side having a straight upper edge and a lower edge; and a bottom wall extending between the lower edge of the cylindrical outer wall and the lower edges of the first side, the second side, and the third side to form a channel between the spout and the cylindrical outer wall, the straight upper edges of the second and third side extending from the first side and through a center line extending perpendicular to the cylindrical wall and parallel to the straight upper edge of the first side;

wherein the upper edge of the first side of the spout is above the upper end of the neck.

20. The insert of claim 19, wherein the angle at which the second side is coupled to the first side is the same as the angle at which the third side is coupled to the first side.

21. The insert of claim 19, wherein the angle at which the second side is coupled to the first side is obtuse.

22. The insert of claim 19, wherein the upper edge of the first side has a first elevation, the upper edge of the second side has a second elevation, and the upper edge of the third side has a third elevation.

23. The insert of claim 22, wherein the first elevation, the second elevation, and the third elevation are equal.

24. The insert of claim 19, wherein at least one of the bottom wall and the cylindrical outer wall includes an aperture configured to provide access to the volume defined by the body when the insert is coupled to the neck.

25. The insert of claim 24, wherein the channel between the spout and the cylindrical outer wall slopes toward the aperture.

26. The insert of claim 24, wherein the lower edge of at least one of the first side, the second side, and the third side slopes toward the aperture.

27. The insert of claim 19, wherein at least one of the first side, the second side, and the third side is substantially parallel to the central axis of the cylindrical outer wall.

28. A container, comprising:

a body defining a partially enclosed volume having an access opening; and an insert integrally formed with the body and cooperating with the access opening, the insert comprising:

an upstanding peripheral wall configured to fit within the access opening;

an upstanding spout located within the peripheral wall, the spout including a first straight portion, a second straight portion and a third straight portion, each straight portion having a substantially straight upper edge and a lower edge, the straight upper edges of the second and third side extending from the first side and through a center line extending perpendicular to the cylindrical wall and parallel to the straight upper edge of the first side, the upper straight edges of the second and third straight portions having a length greater than a length of the upper straight edge of the first straight portion; and a channel disposed between the peripheral wall and the spout, the channel including an aperture for providing access to the volume defined by the body.

29. The container of claim 28, wherein the insert is spin-welded to the body.

30. A paint container, comprising:

a body including a top portion, a flat side, and an arcuate side, the top portion having an opening extending therethrough;

a spout coupled to the body and cooperating with the opening in the top portion, the spout being spaced apart from the body and having a first wall with a straight pouring edge proximate the arcuate side of the body; and a bottom wall located between the body and the spout;

wherein the body, the spout, and the bottom wall form a channel between the body and the spout; and a bail handle coupled to the body, wherein the bail handle is coupled to the body between the flat side and the arcuate side, further comprising a second wall and a third wall extending from opposite ends of the first wall.

31. The paint container of claim 30, wherein the top portion of the body has a first elevation and the straight pouring edge of the first wall has a second elevation.

32. The paint container of claim 30, wherein the top portion of the body has a first elevation and the straight pouring edge of the first wall has a second elevation.

33. The paint container of claim 30, wherein the body of the container is substantially D-shaped.

34. The paint container of claim 30, wherein the bail handle is movable between a rest position and a use position.

35. The paint container of claim 30, wherein the bottom wall further comprises an aperture.

36. The paint container of claim 30, wherein the flat side of the body includes a recess portion.

37. The paint container of claim 36, further comprising a label located within the recess portion.

38. A paint container, comprising:

a body including a top portion, a flat side, and an arcuate side, the top portion having an opening extending therethrough:

a spout coupled to the body and cooperating with the opening in the top portion, the spout being spaced apart from the body and having a first wall with a straight pouring edge proximate the arcuate side of the body; and a bottom wall located between the body and the spout;

wherein the body, the spout, and the bottom wall form a channel between the body and the spout; and a bail handle coupled to the body, wherein the bail handle is coupled to the body between the flat side and the arcuate side, wherein the first wall further comprises a straight edge opposite the straight pouring edge.

39. A paint container, comprising:

a body including a top portion, a flat side, and an arcuate side, the top portion having an opening extending therethrough:

a spout coupled to the body and cooperating with the opening in the top portion, the spout being spaced apart from the body and having a first wall with a straight pouring edge proximate the arcuate side of the body; and a bottom wall located between the body and the spout;

wherein the body, the spout, and the bottom wall form a channel between the body and the spout; and a bail handle coupled to the body, wherein the bail handle is coupled to the body between the flat side and the arcuate side, wherein the bail handle is moveable between a rest position and a use position, and wherein the handle rests on the top portion in the rest position.

40. A paint container, comprising:

a body including a top portion, a flat side, and an arcuate side, the top portion having an opening extending therethrough;

a spout coupled to the body and cooperating with the opening in the top portion, the spout being spaced apart from the body and having a first wall with a straight pouring edge proximate the arcuate side of the body; and a bottom wall located between the body and the spout;

wherein the body, the spout, and the bottom wall form a channel between the body and the spout; and a bail handle coupled to the body, wherein the bail handle is coupled to the body between the flat side and the arcuate side, wherein the bottom wall further comprises an aperture and, wherein the channel slopes toward the aperture.

* * * * *